US006667575B2

(12) United States Patent
Nishida

(10) Patent No.: US 6,667,575 B2
(45) Date of Patent: Dec. 23, 2003

(54) HIGH PRESSURE DISCHARGE LAMP WITH REDUCED BULB THICKNESS

(75) Inventor: Kazuhisa Nishida, Tokyo (JP)

(73) Assignee: NEC Microwave Tube, Ltd., Sagamihara (JP)

( * ) Notice: Subject to any disclaimer, the term of this patent is extended or adjusted under 35 U.S.C. 154(b) by 233 days.

(21) Appl. No.: 09/805,201

(22) Filed: Mar. 14, 2001

(65) Prior Publication Data

US 2001/0038265 A1 Nov. 8, 2001

(30) Foreign Application Priority Data

Mar. 15, 2000 (JP) ..... P2000-073067

(51) Int. Cl.[7] ..... H01J 17/04; H01J 61/04; H01J 17/16; H01J 61/30; H01J 17/20

(52) U.S. Cl. ..... 313/631; 313/632; 313/634; 313/570; 313/571

(58) Field of Search ..... 313/631, 632, 313/634, 570, 571, 567, 573, 574, 623

(56) References Cited

U.S. PATENT DOCUMENTS 5,497,049 A 3/1996 Fischer
5,923,127 A * 7/1999 Keijser et al. ..... 315/224

FOREIGN PATENT DOCUMENTS

JP 54-150873 11/1979
JP 58-129741 8/1983
JP 60-17849 1/1985
JP 2-148561 6/1990
JP 5-290802 11/1993
JP 6-52830 2/1994
JP 6-243831 9/1994
JP 6-342641 12/1994
JP 7-153421 6/1995
JP 7-153423 6/1995
JP 8-185825 7/1996
JP 10-92378 4/1998
JP 11-297274 10/1999

* cited by examiner

*Primary Examiner*—Ashok Patel
*Assistant Examiner*—Matt Hodges
(74) *Attorney, Agent, or Firm*—McGinn & Gibb, PLLC

(57) ABSTRACT

A high pressure discharge lamp includes a quartz glass bulb having an expanded portion and sealing portions, conductive elements, and a pair of electrodes. The conductive elements are sealed at the sealing portions of the quartz glass bulb. Each electrode is disposed so as to be opposite the other and connected to one conductive element. The lamp is characterized in that Dp (the distance between an end of each electrode) is in the range between 1.0 and 1.6 mm, S (the longest length of the expanded portion in the direction of a discharge path)=e×Di (wherein 0.8<e<1.0), Di (the largest inside diameter of the expanded portion transverse to the discharge path)=g×Dp (wherein 4<g<8 ), and Do (the largest outside diameter of the expanded portion transverse to the discharge path)<Di+4 mm.

25 Claims, 3 Drawing Sheets

HIGH PRESSURE DISCHARGE LAMP WITH REDUCED BULB THICKNESS

BACKGROUND OF THE INVENTION

1. Field of the Invention

The present invention relates to a high pressure discharge lamp. More specifically, the present invention relates to a high pressure discharge lamp having a high luminance, a high luminous efficacy, a long life, and high reliability.

2. Description of Related Art

In general, a high pressure discharge lamp has a structure, for instance, as shown in FIG. 2. In the high pressure discharge lamp 1 shown in FIG. 2, each electrode of a pair of electrodes (i.e., an anode 3 and a cathode 4) is disposed so as to be opposite the other in a quartz glass bulb 2, which includes an expanded portion for luminescence 21 and sealing portions 22. The quartz glass bulb 2 is formed by welding the sealing portions 22. The anode 3 and the cathode 4 are joined by, for instance, welding with molybdenum foils 5 and 5'. Also, the sealing portions 22 of the quartz glass bulb 2 are airtightly sealed by, for example, welding with molybdenum foils 5 and 5'. A gas for assisting an electric discharge is contained in the expanded portion for luminescence 21 of the quartz glass bulb 2 which has been airtightly sealed.

High pressure discharge lamps, in general, are required to have characteristics such as a high luminance, a stable and high luminous efficacy, and a long life. As a means for achieving such characteristics of the high pressure discharge lamp from the viewpoint of its shape, the following constitution, for instance, is known as described in the Japanese Unexamined Patent Application, First Publication No. 6-52830.

The high pressure mercury discharge lamp known from the above Japanese patent application includes: a quartz glass lamp vessel having a region surrounding a discharge space; spaced-apart tungsten electrodes disposed in the lamp vessel and defining a discharge path $D_p$ current conductors connected to the electrodes and which extend through the lamp vessel to the exterior; a filling of at least 0.2 mg Hg/mm$^3$, $10^{-6}$–$10^{-4}$ $\mu$mol halogen/mm$^3$ (wherein the halogen is selected from the group consisting of Cl, Br, and I) and a rare gas in the discharge space, the discharge space being spheroidal in shape, having a dimension S in the direction of the discharge path which is S (mm)=e*$D_i$, where e is in the range of 1.0–1.8, $D_i$(mm)=f*(3.2+0.011 (mm/W) *P(W)), where $D_i$ is the largest inside diameter of the discharge vessel transverse to the discharge path, f has a value in the range of 0.9–1.1, P is the power consumed at nominal operation, which is in the range of 70–150 W, the lamp vessel having in the region surrounding the discharge space a convex outer surface, which in a plane in which $D_i$ is situated has an outside diameter $D_o$ which is $D_o \geqq 3.2+0.055$ (mm/W)*P(W), the length of the discharge path $D_p$ is in the range of 1.0–2.0 mm, and bromine is the selected halogen.

However, if the above-mentioned constitution for a discharge lamp is used, the thickness of the quartz glass bulb needs to be significantly increased as the level of electric power is increased and this causes an increase in the dispersion of transmitted beams emitted from an outer surface of the quartz glass bulb. Thus, the optical design of the lamp including a reflector becomes difficult and the luminous efficiency of the optical lens is reduced.

Accordingly, one of the objectives of the present invention is to provide a high pressure discharge lamp having an extremely low degree of electrode deterioration, blackening of a quartz glass bulb, and devitrification even if operated under conditions of high luminance, high internal pressure, and high plasma density.

The inventors of the present invention, after pursuing diligent studies to achieve the above-mentioned objectives, have made observation of the ratio of the longest length in the direction of the discharge path of the expanded portion for luminescence to the largest inside diameter of the expanded portion for luminescence transverse to the discharge path, the ratio of the largest inside diameter of the expanded portion for luminescence transverse to the discharge path to the distance between an end of each of the electrodes, and the difference in length between the largest outside diameter of the expanded portion for luminescence transverse to the discharge path and the largest inside diameter thereof. It was discovered that a high pressure discharge lamp having an extremely low degree of electrode deterioration, blackening of the quartz glass bulb, and devitrification even if operated under conditions of high luminance, high internal pressure, and high plasma density may be obtained without adjusting Di or Do according to the level of the electric power if Dp is in the range between about 1.0 and 1.6 mm, S=e×Di (wherein $0.8 \leqq e < 1.0$), Di=g×Dp (wherein $4 \leqq g \leqq 8$), and Do≧Di+(4 or more), wherein Dp indicates the distance between an end of each electrode, S indicates the longest length of the expanded portion for luminescence in the direction of the discharge path, Di indicates the largest inside diameter of the expanded portion for luminescence transverse to the discharge path, and Do indicates the largest outside diameter of the expanded portion for luminescence transverse to the discharge path.

It is conventionally known that a high pressure discharge lamp of comparatively stable, comparatively high luminous efficacy, and comparatively long life may be obtained if S is larger than Di, and Di and Do are adjusted to a value corresponding to the level of the electric power. However, the thickness of the quartz glass bulb needs to be significantly increased as the level of power supply is increased, and this causes problems such as a decrease in the luminous efficiency of the lamp. It was absolutely unknown and totally unexpected that such problems may be easily solved, without adjusting Di or Do according to the level of the electric power, by applying a value less than Di to S, and by defining the relationship between Di and Dp and that between Do and Di.

SUMMARY OF THE INVENTION

The present invention provides a high pressure discharge lamp including: a quartz glass bulb having an expanded portion and sealing portions; conductive elements, which are airtightly sealed at the sealing portions of the quartz glass bulb; and a pair of electrodes, each electrode of the pair of electrodes being disposed so as to be opposite the other and each electrode being connected to one of the conductive elements; wherein Dp is in the range between about 1.0 and 1.6 mm, S=e×Di (wherein $0.8 \leqq e < 1.0$), Di=g×Dp (wherein $4 \leqq g \leqq 8$), and Do≧Di+4, where Dp indicates the distance between an end of each electrode, S indicates the longest length of the expanded portion in the direction of a discharge path, Di indicates the largest inside diameter of the expanded portion transverse to the discharge path, and Do indicates the largest outside diameter of the expanded portion transverse to the discharge path.

In accordance with another aspect of the invention, the conductive elements are molybdenum foils.

In yet another aspect of the invention, Dp is in the range between about 1.1 and 1.5 mm.

In yet another aspect of the invention, Dp is in the range between about 1.2 and 1.4 mm.

In yet another aspect of the invention, e is in the range of $0.85 \leqq e \leqq 0.95$, and preferably in the range of $0.88 \leqq e \leqq 0.92$.

In yet another aspect of the invention, g is in the range of $4.5 \leqq g \leqq 7$, and preferably in the range of $5 \leqq g \leqq 6$.

In yet another aspect of the invention, $Do \geqq Di+5$, and preferably $Do \geqq Di+6$.

In yet another aspect of the invention, Dp is in the range between 1.1 and 1.5 mm; e is in the range of $0.85 \leqq e \leqq 0.95$; g is in the range of $4.5 \leqq g \leqq 7$; and $Do \geqq Di+5$.

In yet another aspect of the invention, Dp is in the range between 1.2 and 1.4 mm; e is in the range of $0.88 \leqq e \leqq 0.92$; g is in the range of $5 \leqq g \leqq 6$; and $Do \geqq Di+6$.

In yet another aspect of the invention, mercury vapor is contained in the high pressure discharge lamp in an amount between about 0.12 and 0.3 $mg/mm^3$.

In yet another aspect of the invention, a halogen gas is contained in the high pressure discharge lamp in an amount between about $10^{-8}$ and $10^{-2}$ $\mu mol/mm^3$.

In yet another aspect of the invention, an inert gas is contained in the high pressure discharge lamp at a pressure of about 6 kPa or greater.

In yet another aspect of the invention, the bulb wall loading in the high pressure discharge lamp is about 0.8 $W/mm^2$ or greater.

In yet another aspect of the invention, the pair of electrodes comprise tungsten containing potassium oxide.

According to the present invention, it becomes possible to provide a high pressure discharge lamp having an extremely low degree of electrode deterioration, blackening of the quartz glass bulb, and devitrification even if operated under conditions of high luminance, high internal pressure, and high plasma density. Such characteristics of the high pressure discharge lamp become more obvious by restricting Dp, e, g, and Do to a certain range and by selecting mercury vapor to be contained in the high pressure discharge lamp, the halogen gas, the inert gas, the bulb wall loading, and the materials used for the electrodes.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

It is an object of the present invention to provide a high pressure discharge lamp in which the above-mentioned problems have been solved.

It is also another object of the present invention to provide a high pressure discharge lamp having a high luminance, a high luminous efficacy, a long life, and high reliability.

It is yet another object of the present invention to provide a high pressure discharge lamp having an extremely low degree of electrode deterioration, blackening of a quartz glass bulb, and devitrification even if operated under conditions of high luminance, high internal pressure, and high plasma density.

The invention summarized above and defined by the enumerated claims may be better understood by referring to the following detailed description, which should be read with reference to the accompanying drawings. This detailed description of a particular preferred embodiment, set out below to enable one to build and use one particular implementation of the invention, is not intended to limit the enumerated claims, but to serve as a particular example thereof.

Figure 1:
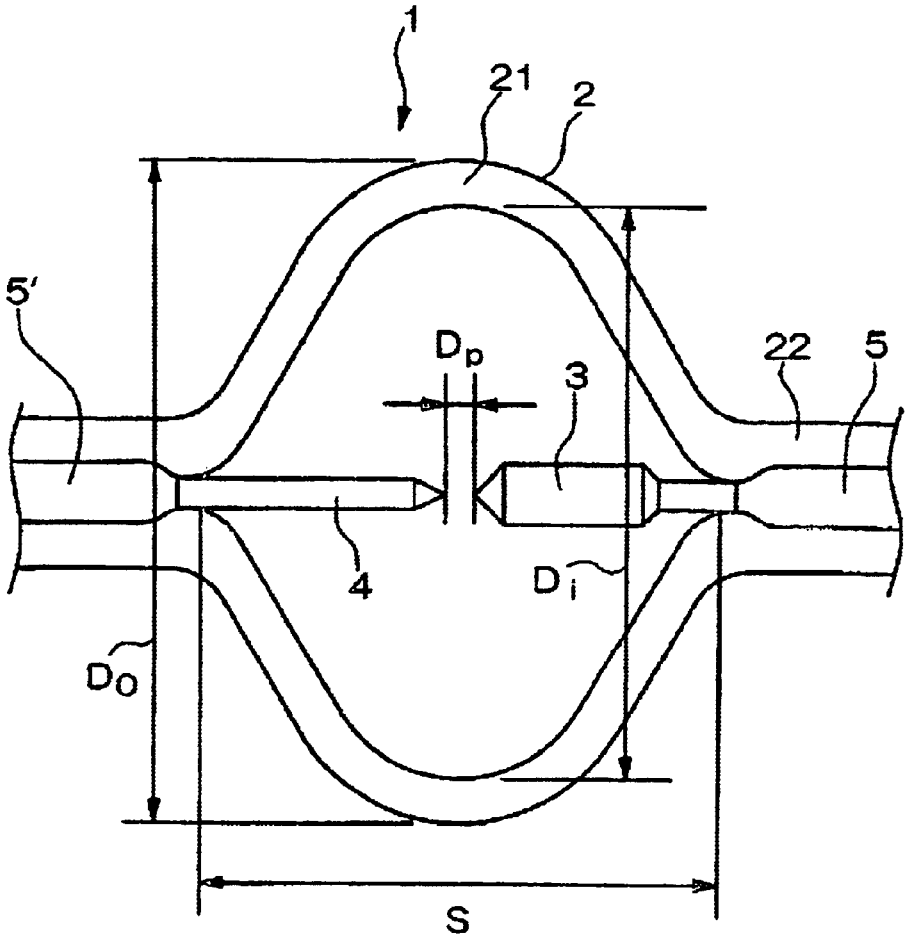
FIG. 1 is a diagram showing a schematic cross-sectional view of a high pressure discharge lamp according to an embodiment of the present invention.
Figure 2:
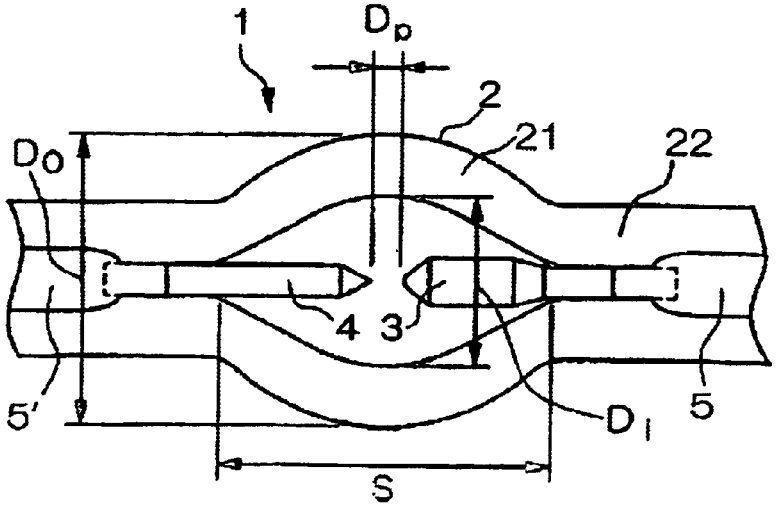
FIG. 2 PRIOR ART
FIG. 2 is a diagram showing a schematic cross-sectional view of a conventional high pressure discharge lamp.

FIG. 1 is a diagram showing a schematic cross-sectional view of a high pressure discharge lamp 1 according to an embodiment of the present invention. In FIG. 1, a high pressure discharge lamp 1 includes a quartz glass bulb 2, an anode 3, a cathode 4, and molybdenum foils 5 and 5'. The quartz glass bulb 2 has an expanded portion 21 and sealing portions 22. The quartz glass bulb 2 may be formed by using a natural or synthetic quartz glass. Also, the quartz glass bulb 2 may be a single layer bulb formed as a one-piece unit or a two or more layer multi-layered bulb. The shape of the anode 3 and that of the cathode 4 may be the same or can be different. The distance between the anode 3 and the cathode 4 is not particularly limited. The anode 3 and the cathode 4 are joined to the molybdenum foils 5 and 5' by, for example, a welding means. The quartz glass bulb 2 is airtightly sealed with the molybdenum foils 5 and 5' at sealing portions 22. A gas for assisting a discharge, such as mercury vapor, is contained and sealed in the expanded portion 21.

It is essential, according to the present invention, that Dp (i.e., the distance between an end of each electrode) is in the range between about 1.0 and 1.6 mm, preferably in the range between about 1.1 and 1.5 mm, and more preferably in the range between about 1.2 and 1.4 mm. It is also essential, according to the present invention, that the ratio e of S (i.e., the longest length of the expanded portion for luminescence in the direction of the discharge path) to Di (i.e., the largest inside diameter of the expanded portion for luminescence transverse to the discharge path) is $0.8 \leqq e < 1.0$, preferably $0.85 \leqq e \leqq 0.95$, and more preferably $0.88 \leqq e \leqq 0.92$. If e is $0.8 \leqq e < 1.0$, it becomes possible to obtain a high pressure discharge lamp having an extremely low degree of electrode deterioration, blackening of the quartz glass bulb, and devitrification even if operated under conditions of high luminance, high internal pressure, and high plasma density. What is meant by "$0.8 \leqq e < 1.0$" is that the length of the expanded portion in the vertical direction is longer than the length thereof in the direction along the length of the electrodes.

It is essential, according to the present invention, that ratio g of Di (i.e., the largest inside diameter of the expanded portion for luminescence transverse to the discharge path) to Dp (i.e., the distance between an end of each electrode) is $4 < g < 8$, preferably $4.5 < g < 7$, and more preferably $5 < g < 6$. If g is $4 < g < 8$, it becomes possible to obtain a high pressure discharge lamp having an extremely low degree of electrode deterioration, blackening of the quartz glass bulb, and devitrification even if operated under conditions of high luminance, high internal pressure, and high plasma density. It is also essential, according to the present invention, that the relationship between Do and Di be $Do < Di+4$ mm, and more preferably $Do < Di+5$ mm, and more preferably $Do < Di+6$ mm. If the relationship between Do and Di is Do<Di+4 mm, it becomes possible to obtain a high pressure discharge lamp having an extremely low degree of electrode deterioration, blackening of the quartz glass bulb, and devitrification even if operated under conditions of high luminance, high internal pressure, and high plasma density.

According to the present invention, it is preferable that mercury vapor be contained and sealed in the high pressure discharge lamp. The amount of mercury vapor is preferably between about 0.12 and 0.3 mg/mm$^3$ and more preferably between about 0.18 and 0.24 mg/mm$^3$. If the amount of mercury vapor is between about 0.12 and 0.3 mg/mm$^3$, it becomes possible to obtain a high pressure discharge lamp having an extremely low degree of electrode deterioration, blackening of the quartz glass bulb, and devitrification even if operated under conditions of high luminance, high internal pressure, and high plasma density.

Also, according to the present invention, it is preferable that a halogen gas is contained and sealed in the high pressure discharge lamp. The amount of the halogen gas is preferably between about $10^{-8}$ and $10^{-2}$ $\mu$mol/mm$^3$ and more preferably between about $10^{-6}$ and $10^{-4}$ $\mu$mol/mm$^3$. If the amount of a halogen gas is between about $10^{-8}$ and $10^{-2}$ $\mu$mol/mm$^3$, it becomes possible to obtain a high pressure discharge lamp having an extremely low degree of electrode deterioration, blackening of the quartz glass bulb, and devitrification even if operated under conditions of high luminance, high internal pressure, and high plasma density. Examples of the halogen gas include chlorine gas, bromine gas, and iodine gas, and these may be used in combination. For the case where two or more halogen gases are used in combination, it is preferable that the total amount of the gases be between about $10^{-8}$ and $10^{-2}$ $\mu$mol/mm$^3$.

Moreover, according to the present invention, it is preferable that an inert gas is contained and sealed in the high pressure discharge lamp. The pressure of the inert gas is preferably about 6 kPa or greater and more preferably between about 20 and 50 kPa. If the pressure of the inert gas is 6 kPa or greater, it becomes possible to obtain a high pressure discharge lamp having an extremely low degree of electrode deterioration, blackening of the quartz glass bulb, and devitrification even if operated under conditions of high luminance, high internal pressure, and high plasma density. Examples of the inert gas include helium gas, neon gas, argon gas, krypton gas, and xenon gas, and these may be used in combination. For the case where two or more inert gases are used in combination, it is preferable that the total pressure of the gases be about 50 kPa or less.

Further, according to the present invention, the bulb wall loading in the high pressure discharge lamp is preferably about 0.8 W/mm$^2$ or greater, and more preferably in the range between about 1.2 and 1.8 W/mm$^2$. If the bulb wall loading is about 0.8 W/mm$^2$ or greater, it becomes possible to obtain a high pressure discharge lamp having an extremely low degree of electrode deterioration, blackening of the quartz glass bulb, and devitrification even if operated under conditions of high luminance, high internal pressure, and high plasma density.

According to the present invention, the materials used for the anode and the cathode are preferably tungsten, molybdenum, and tantalum. The use of tungsten is more preferable and that of tungsten containing potassium oxide is especially preferable. The amount of potassium oxide in tungsten is preferably in the range between about 10 and 30 ppm. If tungsten containing potassium oxide is used, it becomes possible to obtain a high pressure discharge lamp having an extremely low degree of electrode deterioration, blackening of the quartz glass bulb, and devitrification even if operated under conditions of high luminance, high internal pressure, and high plasma density.

Figure 3:
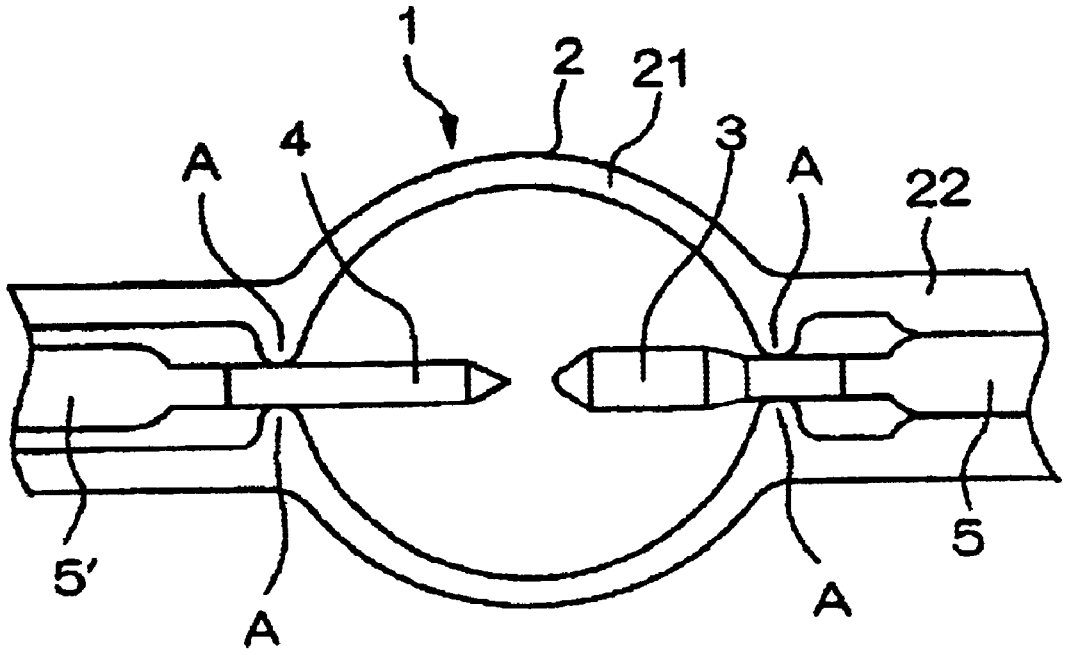
FIG. 3 is a diagram showing a schematic cross-sectional view of a high pressure discharge lamp according to another embodiment of the present invention manufactured by using a prefabricated quartz glass bulb.

As shown in FIG. 3, a high pressure discharge lamp according to another embodiment of the present invention may be manufactured by prefabricating, firstly, extruding portions A (i.e., convex portions A) by processing the quartz glass bulb 2 and then using a conventional method such as a collapsing or a natural fusing (melting) method. Alternatively, a high pressure discharge lamp according to yet another embodiment of the present invention may be produced by applying pressure along the length of an electrode when the sealing portion 22 is formed.

The characteristics of an embodiment of the high pressure discharge lamp according to the present invention are described as follows:

| | |
|---|---|
| Electric power of the discharge lamp: | 120–200 W |
| Voltage of the discharge lamp: | 50–100 V |
| Luminous efficacy: | 40–70 lm/W |
| Bulb wall loading: | 0.8–1.5 W/mm$^2$ |
| Radiation wavelength: | 360–700 nm |

The high pressure discharge lamp according to the present invention may be used in the same manner as a conventional high pressure discharge lamp. That is, when the high pressure discharge lamp of the present invention is connected to a power supply, a trigger voltage is applied to the cathode and the anode to start the discharge. In this manner, a desired luminance of the lamp may be obtained.

Next, the present invention will be described in more detail with reference to particular embodiments. However, the present invention is not by any means to be restricted to the following embodiments.

Embodiment 1 and Comparative Embodiment 1

Using a high pressure discharge lamp having a structure as shown in FIG. 1, the deterioration of tungsten electrodes, the blackening of the quartz glass bulb, and the devitrification thereof were measured.

Figure 4:
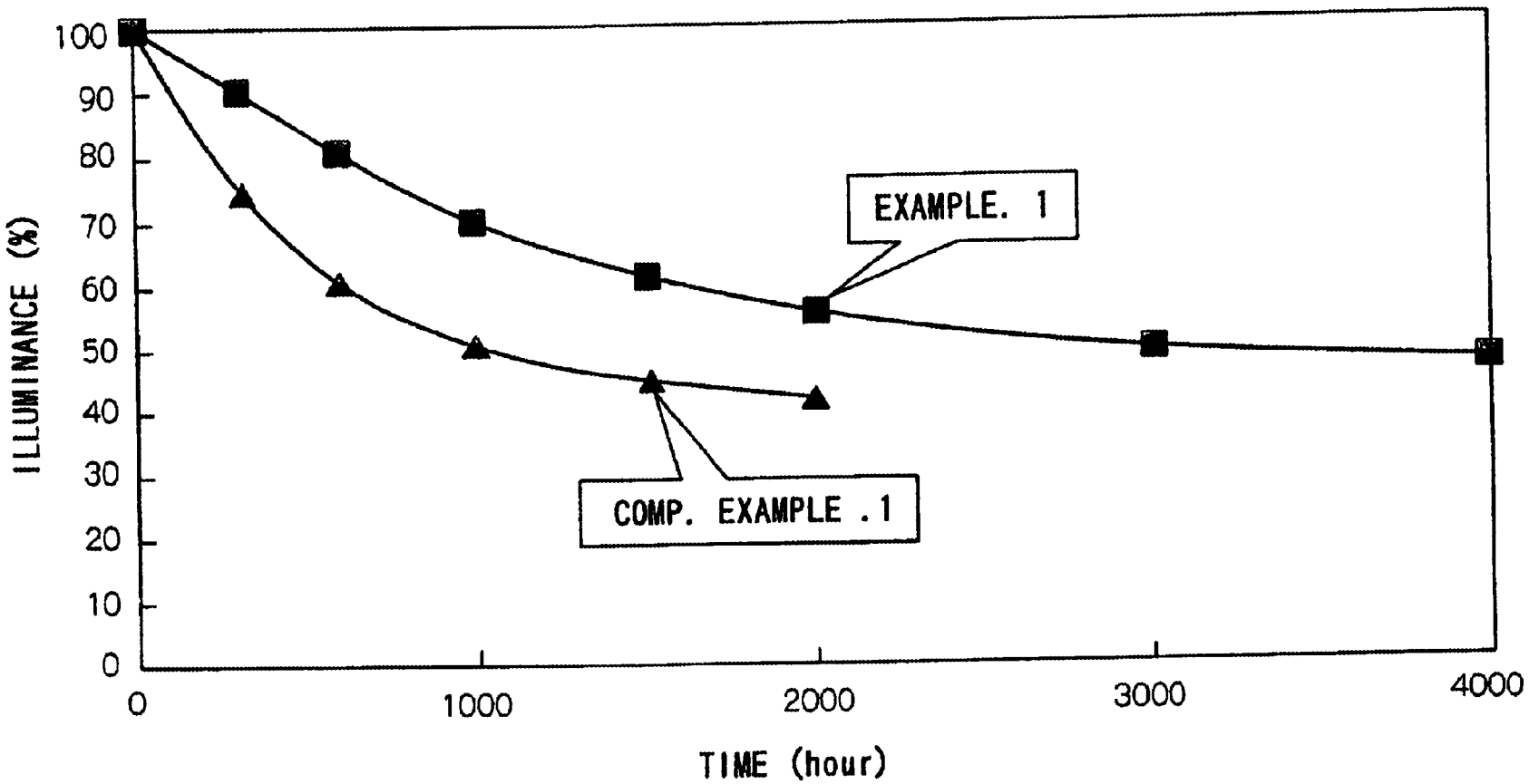
FIG. 4 is a graph showing changes in the illuminance of the high pressure discharge lamp in Example 1 and that in Comparative Example 1 over time (hours).

The high pressure discharge lamp shown in FIG. 1 in which Dp is 1.3 mm, Di is 8 mm (g=6.2), S is 7.5 mm (e=0.94), and Do is 13 mm, was supplied with an electric power of 200 W in order to measure the time needed for reducing the illuminance of the lamp to 50% with respect to the initial illuminance of the lamp which was regarded as 100% due to blackening and devitrification of the lamp. Also, using the same high pressure discharge lamp as in Example 1, except that the length S thereof was changed to 10 mm (i.e., e=1.25), an electric power of 200 W was supplied in order to measure the time needed for reducing the illuminance of the lamp to 50% (Comparative Example 1). Changes in the illuminance of the lamp in Example 1 and Comparative Example 1 versus time (hours) are shown in FIG. 4.

As a result, the time needed for reducing the illuminance of the lamp to 50% was 3,000 hours for the high pressure discharge lamp in Example 1, and 1,000 hours for the high pressure discharge lamp in Comparative Example 1. Accordingly, the effect and function of the high pressure discharge lamp according to an embodiment of the present invention was confirmed. That is, according to the present invention, it becomes possible to provide a high pressure discharge lamp having an extremely low degree of electrode deterioration, blackening of the quartz glass bulb, and devitrification even if operated under conditions of high luminance, high internal pressure, and high plasma density. Such characteristics of the high pressure discharge lamp become more obvious by restricting Dp, e, g, and Do to a certain range and selecting mercury vapor to be contained in the high pressure discharge lamp, the halogen gas, the inert gas, the bulb wall loading, and the materials used for the electrodes.

Having thus described exemplary embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A high pressure discharge lamp, comprising:

a quartz glass bulb having an expanded portion and sealing portions;

conductive elements, which are airtightly sealed at said sealing portions of said quartz glass bulb; and a pair of electrodes, each electrode of said pair of electrodes being disposed so as to be opposite the other and said each electrode being connected to one of said conductive elements, wherein Dp is in the range between about 1.0 and 1.6 mm, $S=e\times Di$, wherein $0.8\leqq e<1.0$, $Di=g\times Dp$, wherein $4<g\leqq 8$, and $Do\leqq Di+4$ mm, and wherein Dp indicates a distance between an end of each of said electrodes, S indicates a longest length of an expanded portion in a direction of a discharge path, Di indicates a largest inside diameter of the expanded portion transverse to the discharge path, and Do indicates a largest outside diameter of the expanded portion transverse to the discharge path.

2. The high pressure discharge lamp according to claim 1, wherein said conductive elements comprise molybdenum foils.

3. The high pressure discharge lamp according to claim 1, wherein Dp is in a range between about 1.1 and 1.5 mm.

4. The high pressure discharge lamp according to claim 1, wherein Dp is in a range between about 1.2 and 1.4 mm.

5. The high pressure discharge lamp according to claim 1, wherein e is in a range of 0.85 $\leqq$e 0.95.

6. The high pressure discharge lamp according to claim 1, wherein e is in a range of $0.88\leqq e$ 0.92.

7. The high pressure discharge lamp according to claim 1, wherein g is in a range of $4.5\leqq g\leqq 7$.

8. The high pressure discharge lamp according to claim 1, wherein g is in a range of $5\leqq g\leqq 6$.

9. The high pressure discharge lamp according to claim 1, wherein $Do\geqq Di+5$ mm.

10. The high pressure discharge lamp according to claim 1, wherein $Do\geqq Di+6$ mm.

11. The high pressure discharge lamp according to claim 1, wherein Dp is in a range between 1.1 and 1.5 in mm, e in a range of 0.085 $\leqq e\leqq 0.95$, g is in a range of $4.5\leqq g\leqq 7$, and $Do\geqq Di+5$ mm.

12. The high pressure discharge lamp according to claim 1, wherein Dp is in a range between 1.2 and 1.4 mm, e is in a range of $0.88\leqq e\leqq 0.92$, g is in a range of $5\leqq g\leqq 6$, and Do is $Do\geqq Di+6$ mm.

13. The high pressure discharge lamp according to claim 1, wherein mercury vapor is contained in the high pressure discharge lamp in an amount between about 0.12 and 0.3 $mg/mm^3$.

14. The high pressure discharge lamp according to claim 1, wherein a halogen gas is contained in the high pressure discharge lamp in an amount between about $10^{-8}$ and $10^{-2}$ $\mu mol/mm^3$.

15. The high pressure discharge lamp according to claim 1, wherein a halogen gas is contained in the high pressure discharge lamp at a pressure of about 6 kPa or greater.

16. The high pressure discharge lamp according to claim 1, wherein a bulb wall loading in the high pressure discharge lamp is about 0.8 $W/mm^2$ or greater.

17. The high pressure discharge lamp according to claim 1, wherein said pair of electrodes comprise tungsten containing potassium oxide.

18. The high pressure discharge lamp according to claim 1, wherein S is less than Di.

19. The high pressure discharge lamp according to claim 1, wherein said sealing portions comprise prefabricated extruding portions situated in contact with said pair of electrodes.

20. The high pressure discharge lamp according to claim 1, wherein said high pressure discharge lamp has an electric power operational range between about 120–200 W.

21. The high pressure discharge lamp according to claim 1, wherein said high pressure discharge lamp has a voltage operational range between about 50–100 V.

22. The high pressure discharge lamp according to claim 1, wherein said high pressure discharge lamp has a luminous efficacy in a range between 40–70 lm/W.

23. The high pressure discharge lamp according to claim 1, wherein said high pressure discharge lamp has a bulb wall loading operational range between 0.8–1.5 $W/mm^2$.

24. The high pressure discharge lamp according to claim 1, wherein said high pressure discharge lamp comprises a 50% reduction in illuminance after about 3,000.

25. A high pressure discharge lamp, comprising:

a quartz glass bulb having an expanded portion and sealing portions;

conductive elements, which are airtightly sealed at said sealing portions of said quartz glasss bulb; and a pair of electrodes, each electrode of said pair of electrodes being disposed so as to be opposite the other and said each electrode being connected to one of said conductive elements, wherein Dp is in the range between about 1.0 and 1.6 mm, $S=e\times Di$, wherein $0.8\leqq e<1.0$, $Di=g\times Dp$, *wherein* $4\leqq g\leqq 8$.

wherein Dp indicates a distance between an end of each of said electrodes, and wherein S indicates a largest inside diameter of said expanded portion transverse to the discharge path.

* * * * *